United States Patent [19]

Woodard

[11] 4,250,647

[45] Feb. 17, 1981

[54] FAST MOUNT SIGN HANGER

[76] Inventor: Charles E. Woodard, P.O. Box 713, Dickson, Tenn. 37055

[21] Appl. No.: 102,984

[22] Filed: Dec. 11, 1979

[51] Int. Cl.[3] ..... G09F 7/22

[52] U.S. Cl. ..... 40/617; 248/244; 248/297.3; 40/607

[58] Field of Search ..... 248/244, 246, 295B; 40/584, 606, 607, 617

[56] References Cited

U.S. PATENT DOCUMENTS

| | | | |
|---|---|---|---|
| 505,008 | 9/1893 | Scottron | 248/246 |
| 576,939 | 2/1897 | Baines | 248/244 |
| 2,004,819 | 6/1935 | Martin | 40/617 |
| 2,486,077 | 10/1949 | Taylor | 248/244 |
| 2,765,136 | 10/1956 | Knapp | 248/246 |
| 2,926,442 | 3/1960 | Reimel | 40/607 |
| 3,245,365 | 4/1966 | Doherty | 248/246 |
| 3,315,393 | 4/1967 | Louft | 40/607 |

FOREIGN PATENT DOCUMENTS

| | | | |
|---|---|---|---|
| 2214342 | 3/1972 | Fed. Rep. of Germany | 40/607 |

*Primary Examiner*—Gene Mancene
*Assistant Examiner*—Wenceslao J. Contreras
*Attorney, Agent, or Firm*—Clarence A. O'Brien; Harvey B. Jacobson

[57] ABSTRACT

An upright standard of non-circular cross section is provided and includes a lower end for anchoring in the ground and an upper end portion including first and second oppositely facing sides. One of the sides is substantially straight longitudinally of the standard and the other side includes a plurality of abutments spaced therealong and projecting outwardly therefrom. A horizontal support arm is provided and includes base and free ends and the base end defines an upstanding opening formed therethrough. The upper end of the standard is slidingly received through the opening with the free arm end projecting laterally outwardly from the straight standard side. The base end of the arm includes an abutment surface spaced below the opening and toward the base end from the side of the opening adjacent the free arm end and abuttingly engageable with the standard straight side one surface. The arm portions on the side of the opening remote from the free arm end define downwardly facing abutment surfaces for engagement with the abutments and the free arm end includes structure for supporting a vertical sign panel therefrom. When the arm is horizontally disposed, the first mentioned abutment surface abuts the one side of the standard and the downwardly facing abutment surfaces engage a corresponding abutment for support of the arm in adjusted elevated position on the standard and the free end of the arm may be inclined upwardly to enable the base end thereof to be shifted longitudinally of the standard.

6 Claims, 5 Drawing Figures

FAST MOUNT SIGN HANGER

BACKGROUND OF THE INVENTION

Various forms of fast mounting sign posts have been heretofore designed such as those disclosed in U.S. Pat. Nos. 2,926,442, 2,952,057, 3,315,393, and 3,529,798. However, these previously known fast mounting signs include various features thereof which either require special tools for support of a sign panel therefrom or render the standard of the sign difficult to drive into the ground with an impact tool such as a hammer. Also, some of the previously known forms of quick or fast mount sign hangers are constructed in a manner which require special sign panels. Accordingly, a need exists for a sign construction which will enable temporary signs to be quickly erected, changed and removed when desired.

BRIEF DESCRIPTION OF THE INVENTION

The quick mounting sign of the instant invention utilizes a conventional wire fence post for the standard thereof and includes a specially constructed sign mounting support arm therefor which may be readily disengaged from the standard and also quickly vertically shifted therealong. Further, the support arm is constructed in a manner whereby a conventional hanging sign panel may be removably supported therefrom.

The main object of this invention is to provide a sign which may be quickly erected whenever desired and which will require utilization of only a simple impact tool in some instances of installation.

Another object of this invention is to provide a sign construction including a standard and horizontal support from which a vertical sign panel may be hung and with the support arm being readily vertically adjustable in desired position along the standard.

Another very important object of this invention is to provide a sign in accordance with the preceding objects and constructed in a manner whereby a plurality of sign panel support arms may be mounted on and adjustably shifted along the standard of the sign.

A further object of this invention is to provide a sign construction which will enable the components of the sign to be disassembled and compactly stored.

Another important object of this invention in accordance with the immediately preceding objects is to provide a sign construction whose components may be readily assembled subsequent to the standard of the sign being driven downwardly into a supportive ground surface.

A further object of this invention is to provide a sign construction which may be readily fabricated from inexpensive commercially available components.

A final object of this invention to be specifically enumerated herein is to provide a sign construction in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
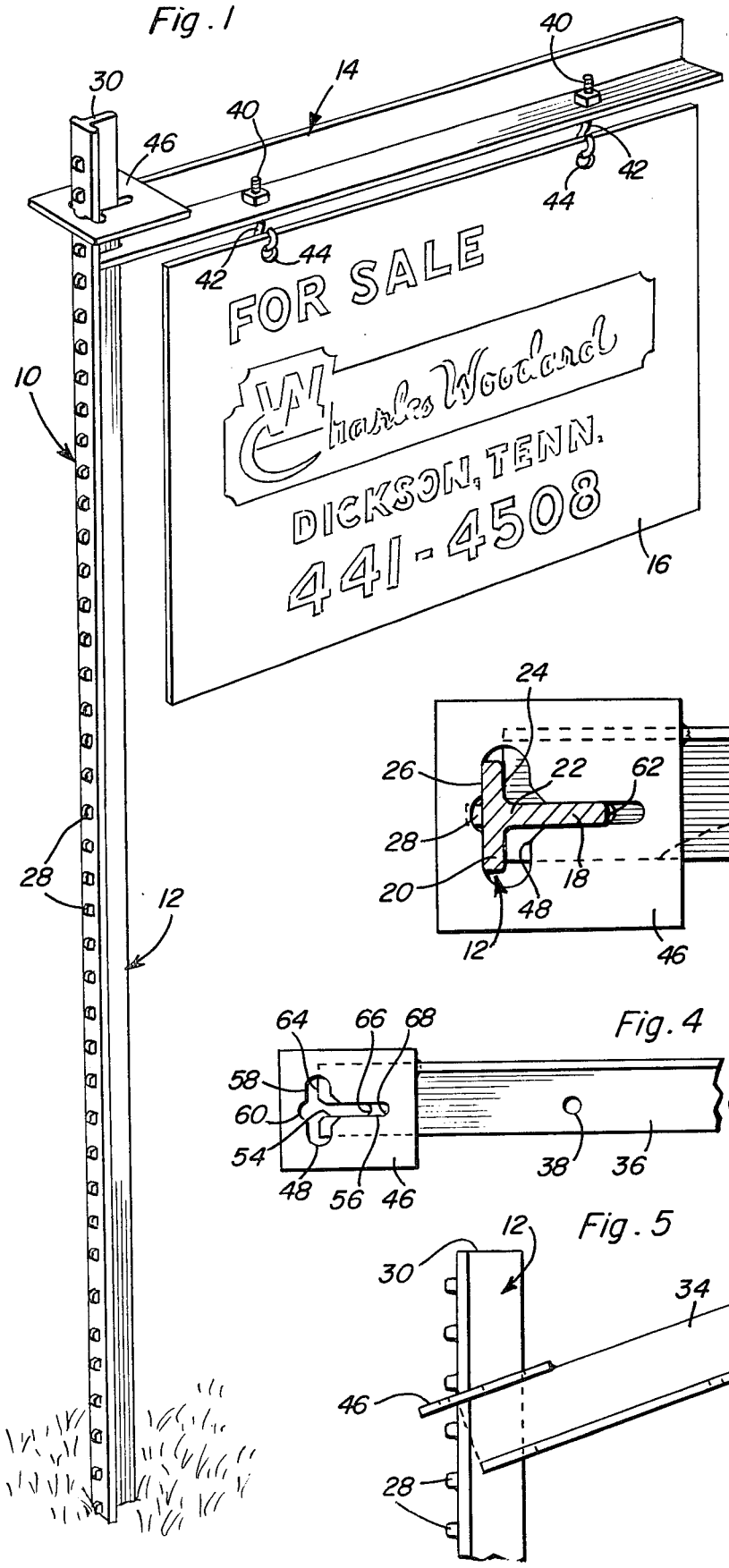
FIG. 1 is a perspective view of a sign structure constructed in accordance with the present invention.

Referring now more specifically to the drawings, the numeral 10 generally designates the sign construction of the instant invention. The sign construction 10 includes a standard referred to in general by the reference numeral 12, a support arm referred to in general by the reference numeral 14 and a sign panel 16.

The standard 12 is generally T-shaped in cross section and includes integrally formed base and cross flanges 18 and 20. The base flange 18 includes a base longitudinal edge 22 formed integrally with and extending along the transverse mid portion of one side face 24 of the cross flange 20. The flanges 18 and 20 are disposed at right angles relative to each other and the other side face 26 of the cross flange 20 includes longitudinally spaced outwardly projecting abutments 28 spaced longitudinally therealong. The standard 12 actually comprises a conventional post for use in constructing a wire fence and may be readily driven down into the ground by impacting an impact tool against the upper end 30 of the standard 12, the lower end (not shown) of that standard 12 being preferably pointed for penetrating the ground.

The support arm 14 comprises a piece of angle iron 32 including an upstanding flange 34 and a horizontal flange 36, the flanges 34 and 36 being joined along adjacent longitudinal edge portions and being disposed at right angles relative to each other. The flange 36 has a pair of longitudinally spaced apertures 38 formed therethrough by which the threaded shank portions 40 of a pair of suspension hooks 42 may be supported from the support arm 14 and the suspension hooks 42 may be engaged in apertures 44 formed in the upper marginal edge portion of the panel 16 in order to support the panel 16 from the support arm 14.

Figure 3:
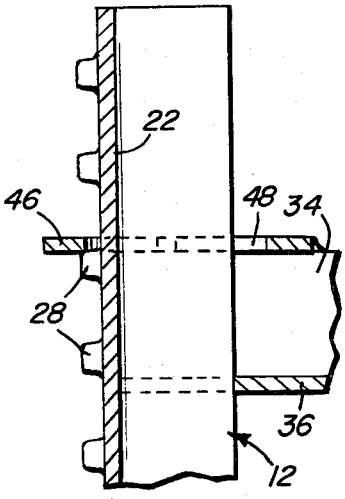
FIG. 3 is an enlarged fragmentary vertical sectional view of the adjacent portions of the standard and support arm.
Figure 2:
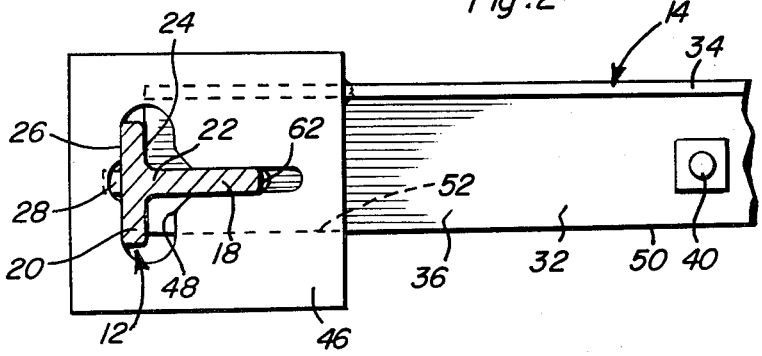
FIG. 2 is a fragmentary enlarged horizontal sectional view taken substantially upon a plane passing through the upper end of the standard and spaced slightly above the support arm.

In addition to the angle iron 32, the support arm 14 includes a plate 46 having a T-shaped opening 48 formed therethrough. The plate 46 is secured (by welding) to the base end of the arm 14 along the upper marginal edge of the flange 34 in a position which can best be determined from FIGS. 2, 3 and 4 of the drawings. Although there is no need to provide a vertical bracing member between the flange 36 and the portion of the plate 46 overlying the free longitudinal edge 50 of the flange 36, a suitable bracing plate may be secured (by welding) between the longitudinal edge 50 at the base of the arm 14 and the underside of a plate 46, along the phantom line 52 in FIG. 2.

The flange 36 has a notch 54 formed in its base end registered with the leg portion 56 of the opening 48 and the cross head portion 58 of the opening 48 includes a central notch 60 registrable with the abutments 28 when the standard 12 is received through the opening 48.

The edge of the opening 48 disposed on opposite sides of the notch 60 oppose the outer side of the cross flange 20 outwardly from which the abutments 28 project and the closed end 66 of the notch 54 abuts the free edge 62 of the base flange 18 while the end edge 64 of the flange 32 on opposite sides of the notch 54 abuts the surface of the cross flange 20 outwardly from which the base flange 18 projects.

Figure 4:
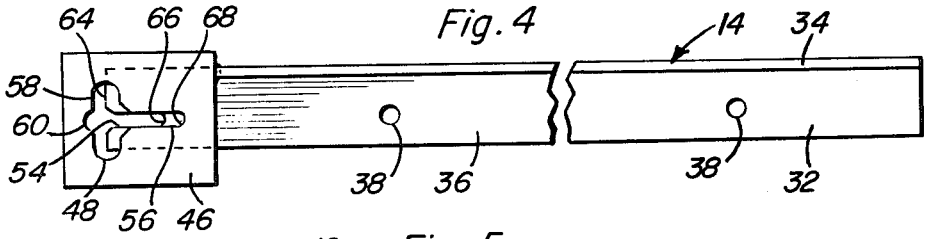
FIG. 4 is a fragmentary top plan view of the support arm.
Figure 5:
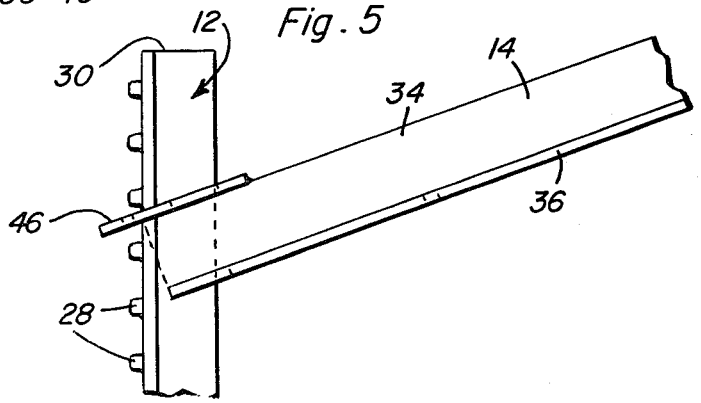
FIG. 5 is a fragmentary side elevational view illustrating the manner in which the support arm may be tilted relative to the standard in order to enable vertical adjustment of the support arm along the standard.

From FIG. 4 of the drawings, it may be seen that the closed end 66 of the notch 54 is spaced slightly toward the base end of the arm 14 from the closed end 68 of the leg portion 56 of the opening 48. Thus, if it is desired to shift the support arm 14 from the position thereof illustrated in FIG. 1, the free end of the support arm 14 is upwardly inclined in the manner illustrated in FIG. 5 of the drawings with the closed end 68 of the leg portion 56 of the opening 48 engaged with the free edge 62 of the base flange 18 and the support arm 14 may then be shifted longitudinally of the standard 12. After the desired new positioning of the support arm 14 along the standard 12. After the desired new positioning of the support arm 14 along the standard 12 has been achieved, the support arm 14 is then returned to the horizontal position such as that illustrated in FIGS. 1 and 3 of the drawings with the closed end 66 of the notch 54 engaged with the free longitudinal edge 62 of the base flange 18 and the end edge 64 of the flange 36 engaged with the one side face 24 of the cross flange 20 of the standard 12. In this manner, the cantilever-supported support arm 14 will have the under surfaces of the plate 46 defining the notch 60 engaged with the associated abutment 28 in order to prevent the support arm 14 from sliding downwardly along the standard 12. Of course, when the support arm 14 is in the inclined position thereof illustrated in FIG. 5 of the drawings, it may be slid upwardly along the standard 12 and from the upper end thereof to completely disengage the support arm 14 from the standard 12.

When it is desired to erect the sign 10, the standard 12 is driven down into the ground through the utilization of an impact tool such as a hammer in the conventional manner. After the standard has penetrated the ground to the desired depth, the support arm 14 may be inclined relative to the standard 12 in the manner illustrated in FIG. 5 but spaced above the upper end of the standard 12 and then downwardly displaced over the support arm to the desired level, after which the support arm 14 may then be swung to the horizontal position.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A sign construction including an upright standard of non-circular cross section, having a lower end for anchoring in the ground and including first and second oppositedly facing side surfaces on at least the upper end portion thereof, one of said surfaces being substantially straight longitudinally of said standard and the other said surfaces including a plurality of abutments spaced therealong longitudinally of the standard and projecting outwardly of the other surfaces, an elongated horizontal sign panel support arm including base and free ends, said base end of said arm defining an upstanding opening formed therethrough of a cross-sectional shape corresponding to the cross-sectional shape of said standard, said upper end portion of said standard being slidably received through said opening with said free end of said arm projecting laterally outwardly from the side of said standard outwardly from which said one surface of said standard faces, said base end of said arm including an abutment surface spaced below said opening and toward said base end from the side of said opening adjacent said free end of said arm and abuttingly engagable with said one surface, the portions of said arm defining the side of said opening remote from said free end defining downwardly facing abutment surfaces for engagement with said abutments, said free end of said arm including means for supporting the upper marginal edge of the vertical sign panel therefrom.

2. The combination of claim 1 wherein said standard and opening are of substantially T-shaped cross section including base leg and cross head portions, the cross head portion of said opening extending transversely of said arm.

3. The combination of claim 2 wherein said arm comprises an angle member including a lower horizontal flange and an upper upstanding flange, a horizontal plate secured in overlying relation to the upper edge of said upper flange, said opening being formed in said plate and said abutment surface being defined by the closed end of an elongated notch opening endwise outwardly of the end of said horizontal flange remote from the free end of said arm.

4. The combination of claim 3 wherein said abutment is also defined by the end edge of said horizontal flange remote from the free end of said arm.

5. The combination of claim 3 wherein said horizontal flange includes a plurality of longitudinally spaced vertical apertures formed therethrough, a pair of suspension hooks including threaded mounting shank portions, said mounting shank portions being secured upwardly through said apertures.

6. The combination of claim 5 wherein said abutment is also defined by the end edge of said horizontal flange remote from the free end of said arm.

* * * * *